US005355543A

United States Patent [19]

Cameron et al.

[11] Patent Number: 5,355,543

[45] Date of Patent: Oct. 18, 1994

[54] LOTTERY CARD SCRAPER APPARATUS

[76] Inventors: Mark R. Cameron; Kelly D. Cameron, both of 301 Bayou Dr., Bay City, Tex. 77414

[21] Appl. No.: 138,869

[22] Filed: Oct. 20, 1993

[51] Int. Cl.[5] ..... B08B 11/00

[52] U.S. Cl. ..... 15/93.1; 15/77; 15/88.3

[58] Field of Search ..... 15/21.1, 77, 88.1, 88.2, 15/88.3, 93.1, 97.1, 102

[56] References Cited

U.S. PATENT DOCUMENTS 4,765,842 8/1988 Sanders et al. ..... 15/77 X 5,253,383 10/1993 Clark ..... 15/88.3

*Primary Examiner*—Edward L. Roberts

*Attorney, Agent, or Firm*—E. Michael Combs

[57] ABSTRACT

A housing is arranged to include side walls, with each of the side walls including communicating and coextensive slots in communication with an internal cavity of the housing, such that a helical blade member is arranged to remove laminate from lottery cards and the like. The scraper blade is arranged in coaxial spaced alignment with a resilient drive roller.

6 Claims, 4 Drawing Sheets

FIG. 3
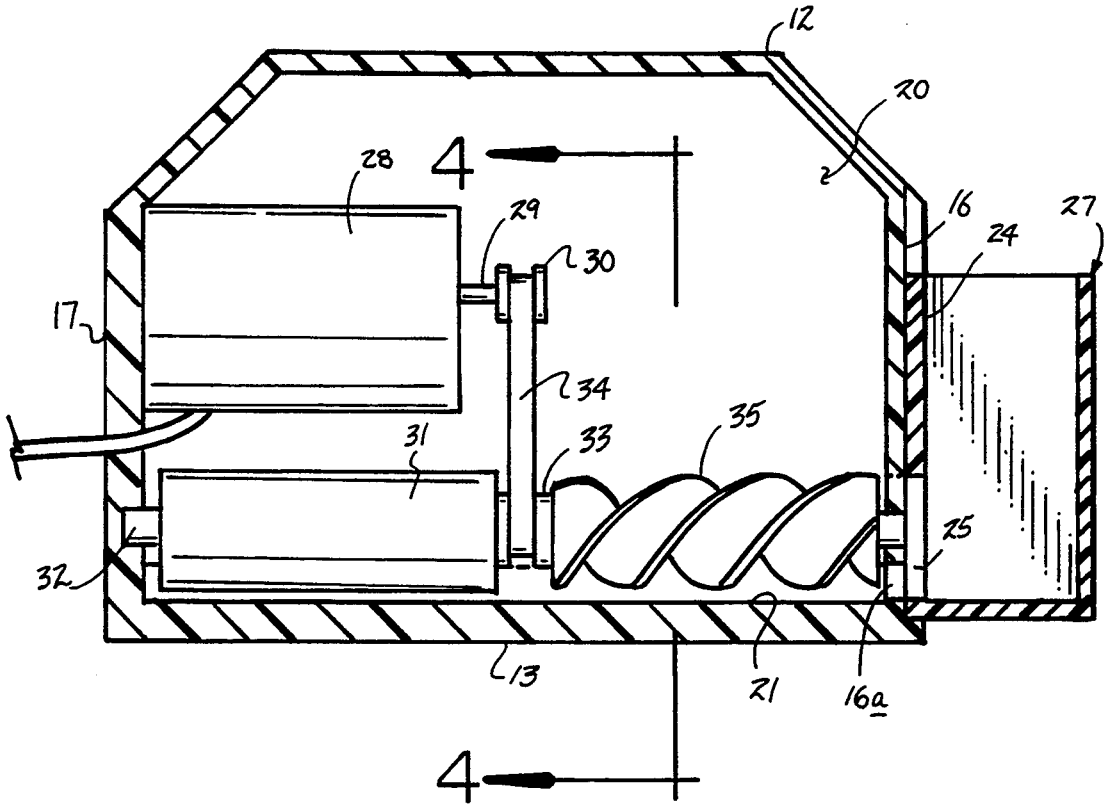
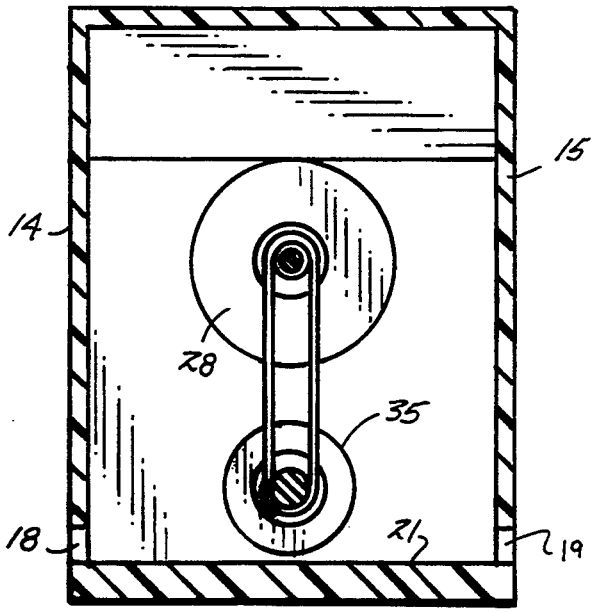
FIG. 4

FIG. 5
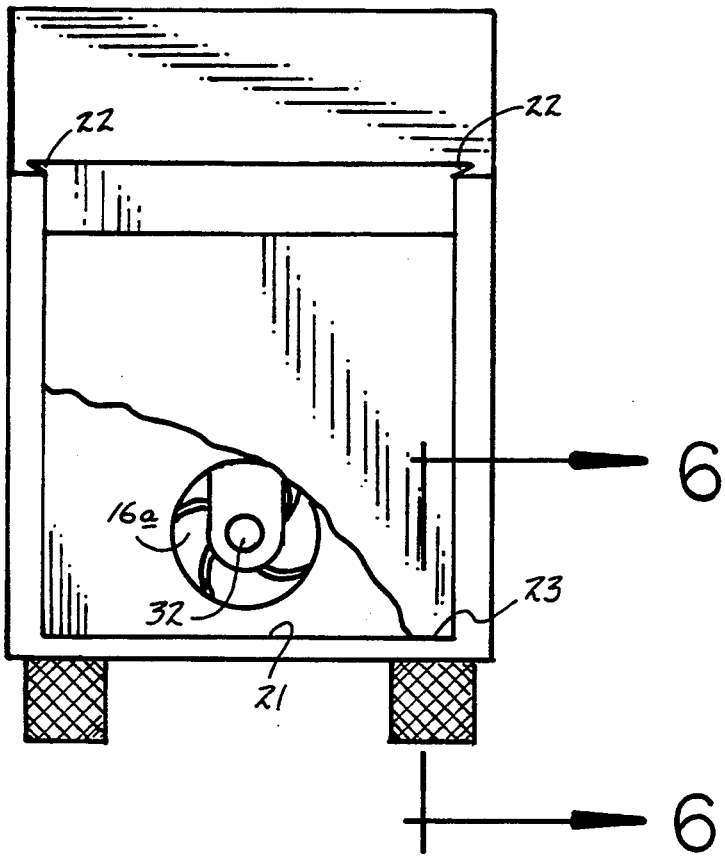
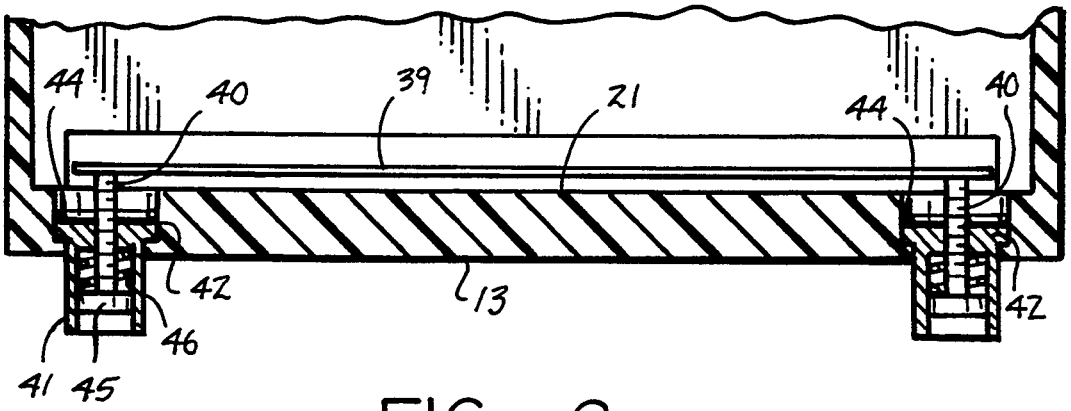
FIG. 6

LOTTERY CARD SCRAPER APPARATUS

BACKGROUND OF THE INVENTION

1. Field of the Invention

The field of invention relates to lottery card scraping apparatus, and more particularly pertains to a new and improved lottery card scraper apparatus wherein the same is arranged to remove covering applied to various lottery cards.

2. Description of the Prior Art

The removal and continuous scraping required in the playing of lottery cards is an arduous procedure such that lottery card scraper structure is indicated in U.S. Pat. No. 4,646,382 and U.S. Design Pat. No. 324,931.

The instant invention sets forth improvements in the prior art by providing for lottery card scraper structure arranged for automatic operation by merely inserting a lottery card within a housing structure that in turn includes a helical blade member and in this respect, the present invention substantially fulfills this need.

SUMMARY OF THE INVENTION

In view of the foregoing disadvantages inherent in the known types of lottery card scraping structure now present in the prior art, the present invention provides a lottery card scraper apparatus wherein the same is arranged to accommodate lottery cards and effect their scraping. As such, the general purpose of the present invention, which will be described subsequently in greater detail, is to provide a new and improved lottery card scraper apparatus which has all the advantages of the prior art lottery card scraping structure and none of the disadvantages.

To attain this, the present invention provides a housing arranged to include side walls, with each of the side walls including communicating and coextensive slots in communication with an internal cavity of the housing, such that a helical blade member is arranged to remove laminate from lottery cards and the like. The scraper blade is arranged in coaxial spaced alignment with a resilient drive roller.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved lottery card scraper apparatus which has all the advantages of the prior art lottery card scraper apparatus and none of the disadvantages.

It is another object of the present invention to provide a new and improved lottery card scraper apparatus which may be easily and efficiently manufactured and marketed.

It is a further object of the present invention to provide a new and improved lottery card scraper apparatus which is of a durable and reliable construction.

An even further object of the present invention is to provide a new and improved lottery card scraper apparatus which is susceptible of a low cost of manufacture with regard to both materials and labor, and which accordingly is then susceptible of low prices of sale to the consuming public, thereby making such lottery card scraper apparatus economically available to the buying public.

Still yet another object of the present invention is to provide a new and improved lottery card scraper apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic view, taken along the lines 3—3 of FIG. 1 in the direction indicated by the arrows.

FIG. 4 is an orthographic view, taken along the lines 4—4 of FIG. 3 in the direction indicated by the arrows.

FIG. 5 is an orthographic end view of the housing structure with the debris container removed therefrom.

FIG. 6 is an orthographic view, taken along the lines 6—6 of FIG. 5 in the direction indicated by the arrows.

DESCRIPTION OF THE PREFERRED EMBODIMENT

Figure 1:
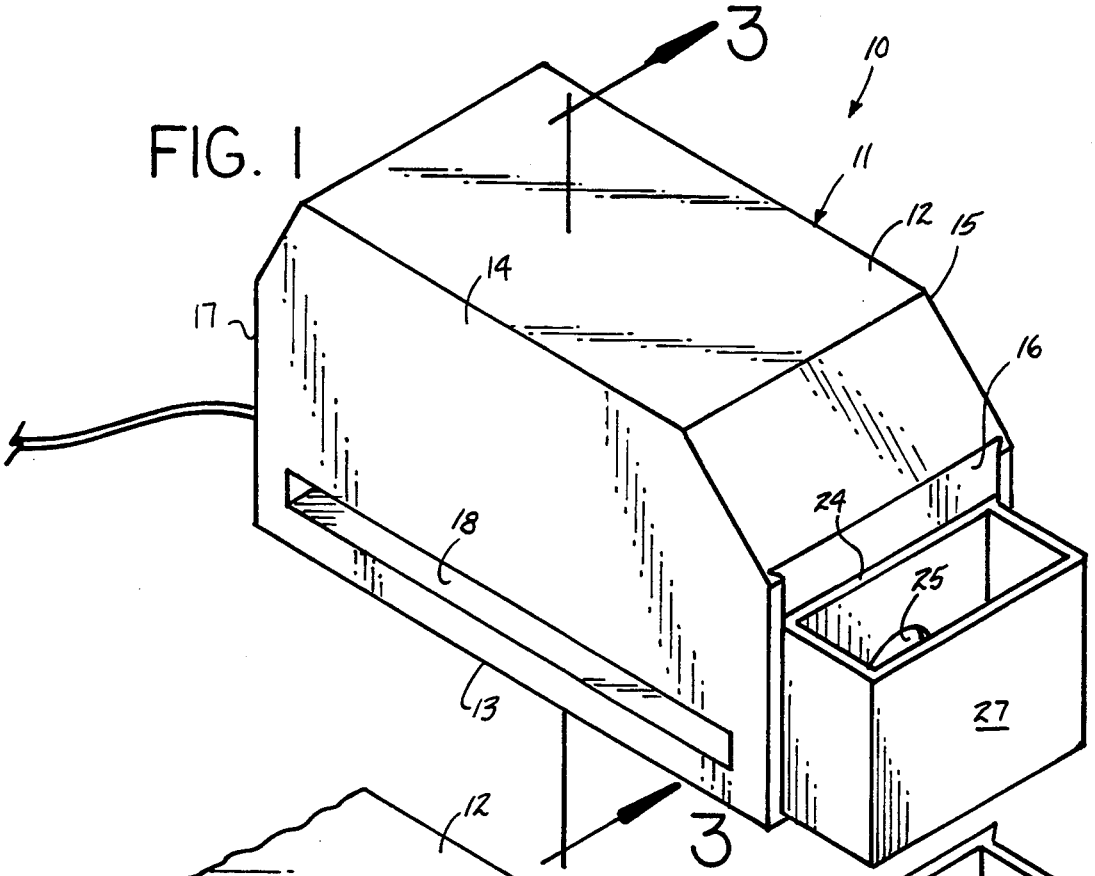
FIG. 1 is an isometric illustration of the invention.
Figure 2:
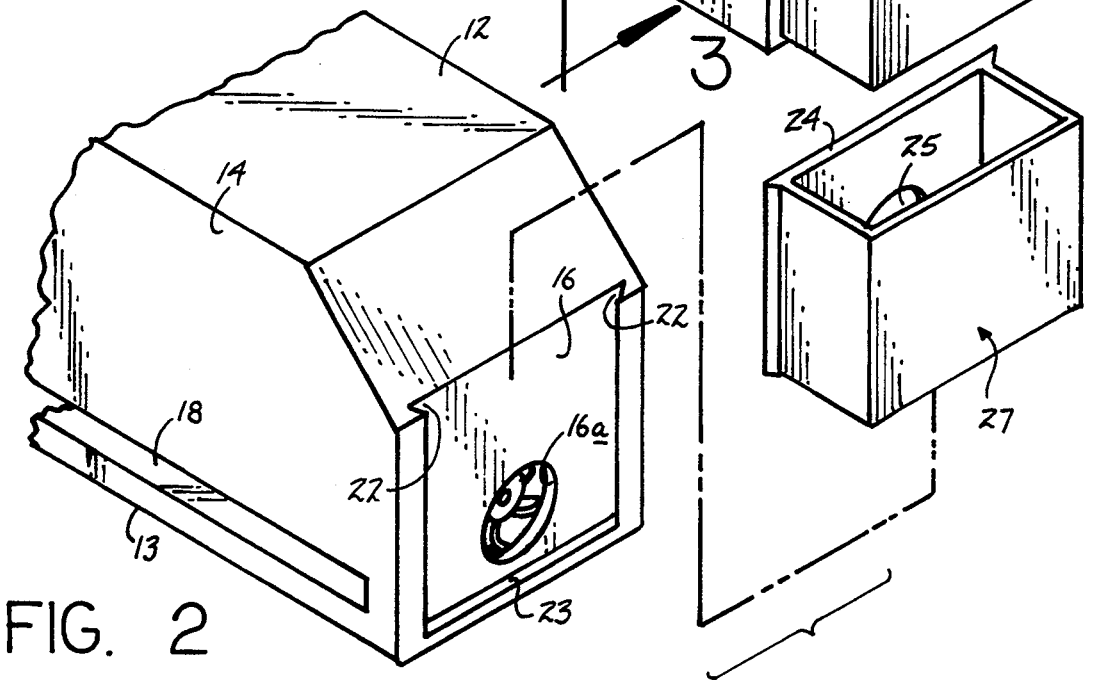
FIG. 2 is a partial isometric illustration indicating the separation of the debris container removed relative to the first end wall of the structure.

With reference now to the drawings, and in particular to FIGS. 1 to 8 thereof, a new and improved lottery card scraper apparatus embodying the principles and concepts of the present invention and generally designated by the reference numeral 10 will be described.

More specifically, the lottery card scraper apparatus 10 of the instant invention essentially comprises a housing 11 having a top wall 12 spaced from a bottom wall 13, a first side wall 14 spaced from a second side wall 15, and a first end wall 16 spaced from a second end wall 17 defining a housing cavity 20 therewithin (see FIG. 3 for example). The first side wall 14 includes an entrance slot 18 positioned in adjacency to the bottom wall 13, and more specifically in communication with the cavity 20 and aligned with the housing floor 21 (see FIG. 4), with the second side wall 15 having an exit slot 19 coextensive with the entrance slot 18 in a parallel relationship, also in communication with and in contiguous orientation to the floor 21. A plurality of dove tail recesses 22 are integral with the first end wall 16 and extend to a recess floor 23, such that the dove tail plate 24 is received between the dove tail recesses 22 for abutment onto the recess floor 23. The dove tail plate 24 mounts a debris container 27 thereon, with the dove tail plate 24 having a plate opening 25 directed therethrough. The housing first end wall 16 is formed with a first end wall opening 16*a* arranged for alignment with the plate opening 25. A drive motor 28 is fixedly mounted within the housing cavity 20 spaced above the floor 21, as indicated in FIG. 3, mounted to the second end wall 17. The drive motor 28 is formed with an output shaft 29 having an output shaft pulley 30. A resilient cylinder 31 is arranged for spaced coaxial alignment with a rigid helical blade 35, having a central pulley 33 mounted therebetween also coaxially aligned relative to the resilient cylinder 31 and the rigid helical blade 35, with the components 31, 33, and 35 fixedly mounted about an axle 32 that extends from the first end wall 16 to the second end wall 17. A resilient drive belt 34 is mounted between the output shaft pulley 30 and the central pulley 33. In this manner, a lottery card (not shown) directed into the entrance slot 18 is pulled through the cavity 20 to the exit slot 19 by the resilient cylinder 31, while the helical blade 35 scrapes the card that is oriented between the helical blade 35 and the floor 21. Further, a lottery card may be put in endwise to avoid the resilient cylinder 30 and merely orient a portion to be scraped between the blade 35 and the floor 21.

The FIGS. 5 and 6 indicates the further use of an adjuster plate 39 arranged for mounting coextensively of the floor 21 arranged for lifting a lottery card and closing a gap between the adjuster plate 39 and the rigid helical blade 35. The adjuster plate includes a plurality of threaded rods 40 fixedly and orthogonally mounted to the adjuster plate 39, with each of the threaded rods 40 extending through the floor, as well as the bottom wall 13 and projecting below the bottom wall 13, with each of the threaded rods received within the adjusting tube 41 that is rotatably mounted into the bottom wall 13. Each adjusting tube 41 includes an adjusting tube internally threaded web 42 threadedly receiving the respective threaded rod 40 therethrough, such that rotation of the adjusting tube 41 that is captured between a lock flange 44 and the bottom wall 13 prevents axial displacement of each respective adjusting tube 41 relative to the bottom wall 13. Further, a rod flange 45 mounted to the rod at a distal end thereof spaced from the adjuster plate 39 captures a spring 46 between the rod flange and the adjusting tube web 42. In this manner, rotation of the adjusting tubes 41 permits reciprocation of the adjuster plate relative to the floor 21.

Figure 7:
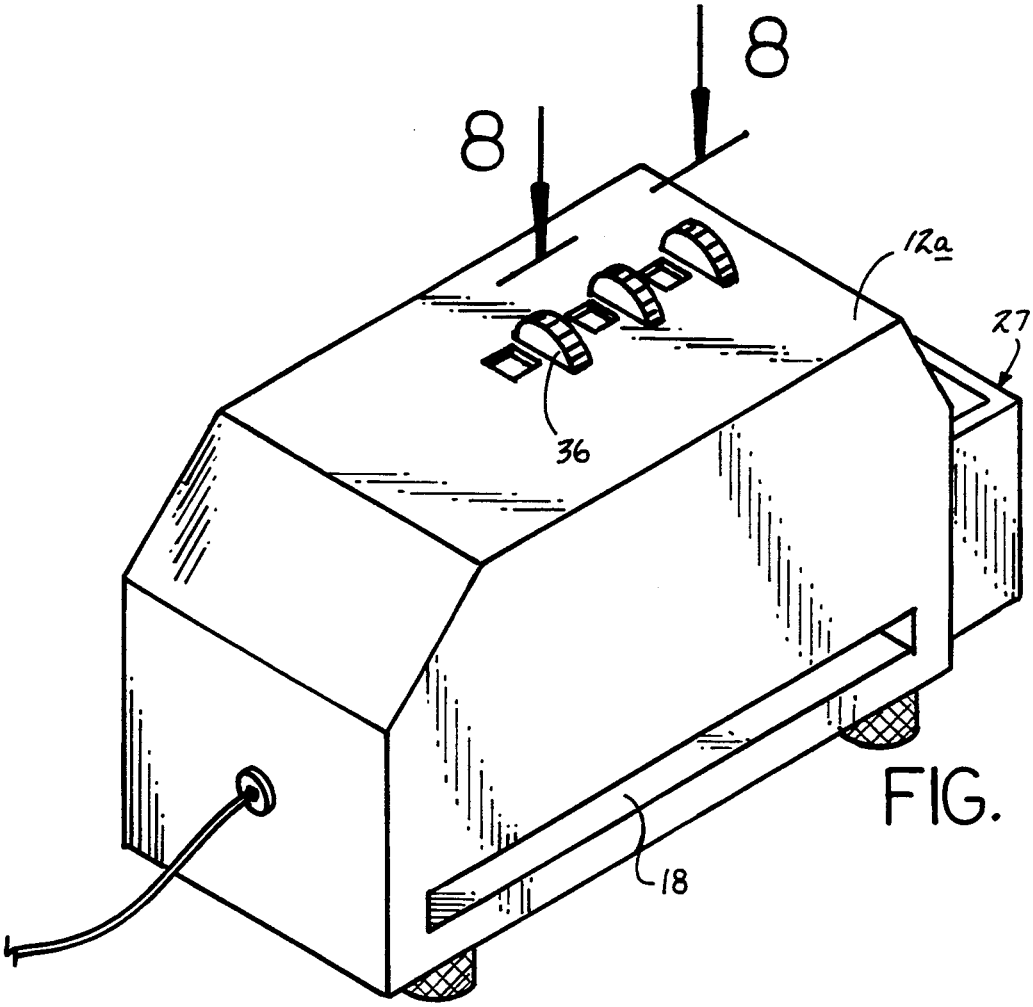
FIG. 7 is an isometric illustration of a modified top wall structure of the housing employing a counter organization.
Figure 8:
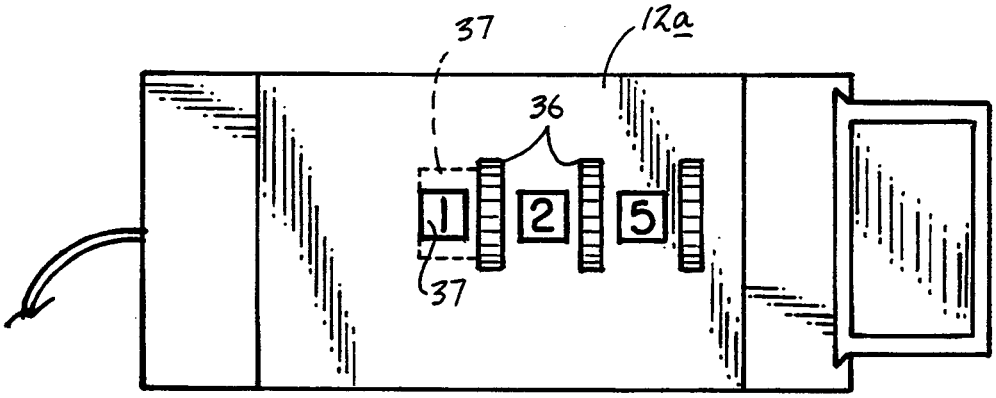
FIG. 8 is an orthographic view, taken along the lines 8—8 of FIG. 7 in the direction indicated by the arrows.

The FIGS. 7 and 8 indicates the use of a plurality of rotary dials 36 projecting through a modified top wall 12*a*, such that each rotary dial 36 fixedly mounts a dial cylinder 37 therein for viewing through a respective window of the top wall 12*a*. Each of the dial cylinders 37 includes an annular numerical array thereon for providing for an individual to count the number of lottery cards to be directed through the apparatus 10.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A lottery card scraper apparatus, comprising, a housing, the housing including a top wall spaced from a bottom wall, a first side wall spaced from a second side wall, a first end wall spaced from a second end wall, and the housing including a housing cavity, and an entrance slot directed through the first side wall, the second side wall including an exit slot, with the entrance slot and the exit slot arranged in a coextensive parallel relationship relative to one another, the bottom wall includes a floor within the housing cavity, with the floor in contiguous communication with the entrance slot and the exit slot, and an axle rotatably mounted to the first end wall and the second end wall parallel to the floor, the axle including a resilient drive roller, a rigid helical blade member, with the drive roller and the blade member coaxially aligned in a spaced relationship relative to one another, with a central pulley mounted coaxially to the axle between the resilient cylinder and the helical blade, and drive means mounted within the cavity for effecting rotation of the axle, with the drive means including a drive means pulley, and the drive means pulley and the central pulley including a drive belt extending therebetween.

2. An apparatus as set forth in claim 1 wherein the first end wall includes a first wall opening, the first end wall including a plurality of spaced parallel dove tail recesses, and the dove tail recesses orthogonally mounted to a recess floor, with the dove tail recesses arranged to receive a dove tail plate, the dove tail plate arranged for abutment with the recess floor, and the dove tail plate including a dove tail plate opening coextensive with the first end wall opening, with the dove plate in contiguous communication with the recess floor.

3. An apparatus as set forth in claim 2 wherein the dove plate includes a debris container mounted to the dove tail plate to receive debris directed through the dove tail plate opening and the first end wall opening.

4. An apparatus as set forth in claim 3 including an adjuster plate coextensive with the housing floor and oriented between the housing floor and the axle, and the adjuster plate including a plurality of threaded rods fixedly mounted to the adjuster plate in an orthogonal relationship, with the threaded rods each extending slidably through the bottom wall projecting beyond the bottom wall, and a plurality of adjusting tubes, and each of the adjusting tubes receiving ode of said threaded rods therethrough, and each of the adjusting tubes including an adjusting tube internally threaded web threadedly engaging an individual one of said threaded rods, with each of the adjusting tubes extending orthogonally below the bottom wall.

5. An apparatus as set forth in claim 4 wherein each of the threaded rods includes a rod flange and a plurality of springs, with an individual one of said springs captured between each said rod flange and respective one internally threaded web.

6. An apparatus as set forth in claim 5 including a plurality of rotary dials projecting through the top wall, and each of the rotary dials including a dial cylinder, and each dial cylinder having a numerical array, and the top wall having a plurality of windows, with each window positioned adjacent an individual one of said rotary dials for viewing said numerical array.

* * * * *